United States Patent [19]

Tschudy et al.

[11] 4,091,463

[45] May 23, 1978

[54] MIXER, ESPECIALLY PRINTING INK MIXER

[75] Inventors: Roland Tschudy, Oberuzwil; Eduard Schiess, Gossau, both of Switzerland

[73] Assignee: Gebruder Buhler AG, Switzerland

[21] Appl. No.: 725,290

[22] Filed: Sep. 21, 1976

[30] Foreign Application Priority Data

Sep. 25, 1975 Switzerland ..... 12452/75

[51] Int. Cl.[2] ..... B01F 7/16

[52] U.S. Cl. ..... 366/298; 366/299; 366/300; 366/315

[58] Field of Search ..... 259/104, 6, 21, 41, 259/64, 84, 103, 105, 179

[56] References Cited

U.S. PATENT DOCUMENTS

| | | | |
|---|---|---|---|
| 2,020,450 | 11/1935 | Andis | 259/104 |
| 3,342,459 | 9/1967 | Myers et al. | 259/104 |
| 3,414,239 | 12/1968 | Eirich et al. | 259/104 |
| 3,893,811 | 7/1975 | Good et al. | 259/104 X |

FOREIGN PATENT DOCUMENTS

| | | | |
|---|---|---|---|
| 1,164,378 | 3/1964 | Germany | 259/104 |

*Primary Examiner*—Philip R. Coe
*Attorney, Agent, or Firm*—McGlew and Tuttle

[57] ABSTRACT

A vat or bucket mixer, especially for commingling liquid- and powder components during the production of printing inks, comprising a mixing tool mounted for rotation at a first shaft and extending up to the region of the inner wall of the vat and a dissolver disk driven by a second shaft. A common drive motor is provided for the shaft of the mixing tool and the shaft of the dissolver disk, and means selectively connect and disconnect the shaft of the dissolver disk.

4 Claims, 2 Drawing Figures

MIXER, ESPECIALLY PRINTING INK MIXER

BACKGROUND OF THE INVENTION

The present invention relates to a new and improved construction of mixer arrangement and, in particular, relates to a vat or bucket mixer equipped with a mechanical drive arrangement, especially for the commingling or mixing together of liquid- and powder components, for instance when producing printing inks or the like, and which mixer is of the type comprising a rotatable mixing tool extending to the region of the inner wall of the vat and a toothed disk driven by a shaft, this toothed disk constituting a so-called dissolver disk.

In order to mix ttogether liquid- and powder components there are placed upon the mixer, among other things, the following specific requirements:

(a) Disintegration or tearing apart of the agglomerates;

(b) Optimum dispersion of the constituents; and (c) Good wetting of the individual pigments.

The properties of the different components should not be destroyed, something which oftentimes is a problem in the case of products which are difficult to work with, such as for instance heat-sensitive products, viscous pastes or thixotropic products.

Moreover, the working operations should be accomplished in an environmentally safe manner, i.e. there should be developed as little dust as possible.

The heretofore known previously described mixers possess two separate drive units. Consequently, it is possible to initially carry out the pre-mixing or starting mixing operation at a relatively low rotational speed with the aid of the mixing tool, so that the power requirements are maintained small and also the formation of dust is low.

After the pre-mixing there is connected the dissolver disk by means of the separate motor in order to disintegrate the agglomerates and to achieve optimum dispersion and use of the powder components. The pre-mixing phase or starting mixing phase, lasts only about five minutes, during which time there is only in operation the mixing tool, and the second phase, during which time there are in operation the mixing tool and the dissolver disk depending upon the strived for quality of the product, lasts up to one hour and more.

By separating the drive for the mixing tool and the dissolver disk it is possible to easily obtain variations in the rotational speed. The determination of the power requirements must be carried out individually both for the mixing tool as well as for the dissolver disk, yet in both instances is difficult. Since it must be presupposed that both demand increased power requirements, it is necessary to design both motors so as to also have the corresponding safety factor, resulting in relatively large structural requirements, and only during part of the fields of application are there in fact realized the advantages.

SUMMARY OF THE INVENTION

It is therefore a primary object of the present invention to provide a new and improved construction of a mixer arrangement which is not associated with the aforementioned drawbacks and limitations of the prior art proposals.

Another and more specific object of the present invention aims at improving the heretofore known mixers working with mechanical drive, so that while at least retaining all of the functional requirements, there can be realized a less complicated construction.

Now in order to implement these and still further objects of the invention, which will become more readily apparent as the description proceeds, the mixer of the present development is manifested by the features that a common drive motor is provided for the shaft of the mixing tool and the shaft of the toothed disk, and means serve for selectively connecting and disconnecting the shaft of the toothed disk.

It has been found that the invention affords surprising advantages exceeding the solution of the problem. It has been determined that the power requirements with such type mixing problems decreases both for the mixing tool as well as for the dissolver disk as the mixing operation proceeds, that in particular however directly after turning-on the motor there is regularly present a peak of the current consumption. Just this fact is beneficially utilized by the invention in that the connection of the dissolver disk first is accomplished after the premixing phase, for instance after five minutes. The peak of the power requirement of the dissolver disk therefore coincides with an already markedly reduced value of the power requirement for the mixing tool, so that in consequence thereof the single motor can be designed to have a smaller power output than that of both heretofore used motors. What is of even greater significance is that the power peaks both of the mixing tool and of the dissolver disk, can be better handled by a large motor than the same peaks by a smaller motor. It has in fact been determined that, with the novel solution proposed by the invention, the load or power peaks are less pronounced, presumably because there can be utilized the mass forces of the already moved mechanical components. Hence, with the invention there can be realized a simpler construction without impairment of the function.

Further, there have been found a number of very advantageous constructional embodiments of the invention. According to a preferred embodiment there are provided means in order to drive the mixing tool contra to the toothed disk, so that the work effect can be increased by the shearing forces.

The arrangement of a reversing gear means at the mixing tool not only enables reducing the structural expenditure in equipment, but further affords considerable operating advantages, for instance for the exchange of the mixing tool, the maintenance, the cleaning and so forth, when the shaft of the mixing tool is connected directly with the reversing gear means.

It is preferred in the shafts of the mixing tool and the dissolver disk are guided in parallelism with one another, since in this way there is also obtained a constructional advantage.

Furthermore, the invention allows for regulation of the rotational speed of the mixing tool and/or the toothed disk, and the control of the switching-in and possibly switching-off of the toothed disk enables optimum loading of the drive motor, so that with the selected drive power and corresponding construction there can be uniformly operated at the maximum work load and, accordingly, the work operations can be carried out in the shortest time with the smallest possible motor output of power.

The last-mentioned exemplary embodiment affords extremely favorable pre-conditions for automatic operation. There is present a notable advantage. Prior to connecting or switching-in the toothed disk the rotational speed of the mixing tool can be lowered, and for instance then first again increased when the necessary power requirements for the toothed disk begin to drop. This solution, even in extreme cases, enables working with a single, relatively small motor and nonetheless there can be attained a small mixing time for a given quality of the product.

According to a preferred exemplary embodiment, the drive of the rapidly rotating shaft is undertaken at a non-variable rotational speed, whereas for the drive of the slowly rotating shaft, i.e. the continuously driven shaft, there are provided means for adjusting the rotational speed, such as for instance a V-belt variator.

According to another constructional embodiment, the means for adjusting the rotational speed are provided at that part of the gear means or transmission which is common to both shafts, so that the rotational speeds of both shafts can be adjusted proportional to one another. Also in this case there again is suitable a V-belt variator for adjusting the rotational speeds.

The mixer or mixer arrangement of the presence invention has the advantage that there can be realized an optimum efficiency of the machine, since a single motor is completely adequate for solving the problems. There are no difficulties regarding branching-off the power. According to a preferred construction of the invention utilizing oppositely rotating shafts, there is realized a particularly optimum mixing since there is an addition of the shearing forces which act upon the mixed material.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
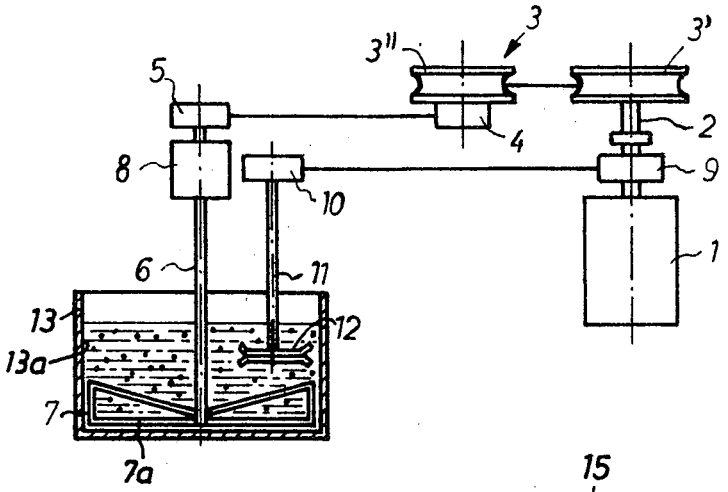
FIG. 1 schematically illustrates a mixer constructed according to the invention wherein the rotational speed of the dissolver shaft which can be connected and disconnected, as required, cannot be varied.

Describing now the drawings, in FIG. 1 there is schematically illustrated the construction of a mixer or mixer arrangement according to the invention. Serving as the drive is an electric motor 1 which, through the agency of a shaft 2, drives for instance a V-belt variator 3. The variator 3 essentially consists of the pulleys 3' and 3'' as well as the adjustment means for changing the groove width of one of the pulleys 3' and 3'' and thus the rotational speed of a belt disk 4 at the power take-off side of the variator 3. This variator 3 which is basically a speed-change device is a commercially available structure, wherein the rotational speeds can be altered, for instance, in a ratio of 1:5, i.e. the minimum rotational speed amounts to $n$ and the maximum rotational speed amounts to $5n$ at the power take-off side of the variator 3. By means of the pulley 3'' there is driven through the agency of the belt pulley 4 seated upon the same shaft, the belt pulley 5 of the main shaft 6, i.e. the shaft of the mixer or mixing tool 7*a*. The shaft 6 carries as the mixing tool 7*a* the butterfly vane 7 and forms the continuously driven, slowly rotating shaft. Arranged ahead of the shaft 6 and operatively connected therewith is a reduction- and reversing gear means or transmission 8 which, in the illustrated embodiment, reduces the rotational speed in a ratio of 1:15 and at the same time reverses the direction of rotation.

Seated upon the shaft 2 is a coupling or clutch, for instance a hydraulic multiple disk clutch 9, the outer ring of which also is constructed as a belt pulley, and thus drives the belt pulley 10 seated at the shaft 11. This shaft 11 carries the dissolver disk 12 and can be selectively connected and disconnected, respectively, by means of the clutch 9. The rotational speed of the dissolver shaft 11 is not adjustable in the embodiment under discussion, i.e. it depends directly upon the rotational speed of the drive motor 1. The mixing tool 7*a*, i.e. the butterfly vane 7 extends up to the region of the inner wall 13*a* of the vat or bucket 13 or the like which allows for optimum mixing of the components.

Figure 2:
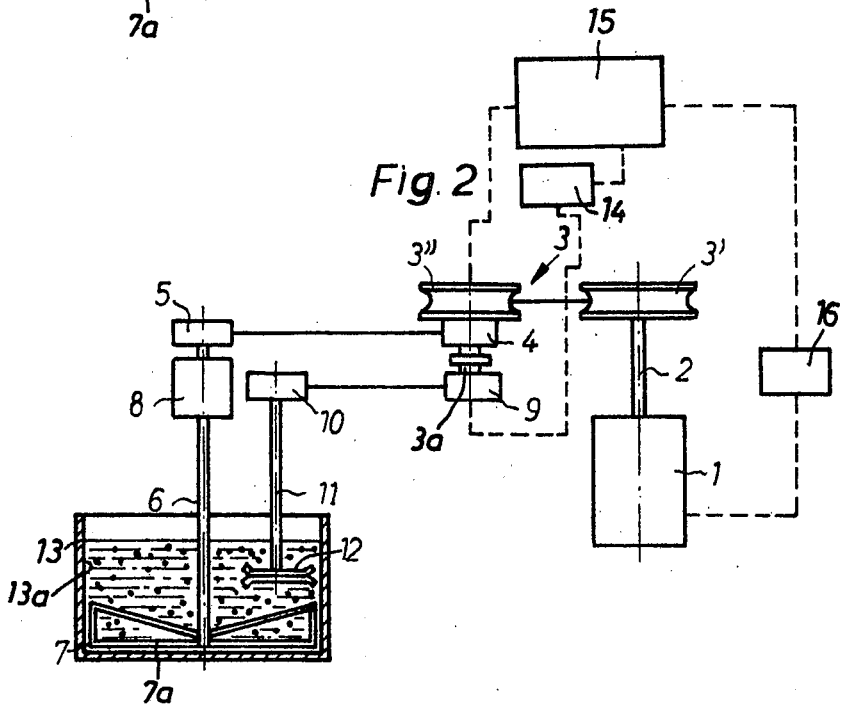
FIG. 2 illustrates an exemplary embodiment of mixer wherein the rotational speed of both shafts can be adjusted proportionally with regard to one another.

In FIG. 2 of the drawing there is likewise schematically illustrated a variant of the mixer of FIG. 1. Since this mixer construction basically is composed of the same components as that of FIG. 1 there have been conveniently utilized the same reference characters for the same components.

The most significant difference resides in the fact that the clutch 9 for respectively switching-in and switching-off the drive of the dissolver shaft 11 is arranged upon the shaft 3*a* of the power take-off pulley 3'' of the V-belt variator 3. Due to this construction and arrangement, it is possible to simultaneously and proportionally to one another alter the rotational speeds of both shafts 6 and 11.

Moreover, with this embodiment there is provided a control cabinet 14 for the automatic connection or disconnection, respectively, of the dissolver shaft 11, and a control cabinet 15 for the rotational speed-regulation of the mixing tool shaft 6 — as a function of or independently of the rotational speed of the motor 1. In the control circuit there is connected a regulator 16 between the motor 1 and the control cabinet 15. In this way it is possible for there to be accomplished the above-described rotational speed-regulation of the mixing tool and/or the dissolver, in order to ensure for optimum utilization of the power output of the drive motor.

While there are shown and described present preferred embodiments of the invention, it is to be distinctly understood that the invention is not limited thereto, but may be otherwise variously embodied and practiced within the scope of the following claims. Accordingly,

What is claimed is:

1. A vat mixer for admixing liquid and powder components for the production of printing ink, comprising a vat having an inner wall, a mixing tool shaft rotatably mounted so as to extend centrally downwardly into said vat, a mixing tool affixed to said mixing tool shaft for rotation therewith and having a periphery disposed in close proximity to said inner wall during the rotation, a dissolver disk shaft rotatably mounted so as to extend downwardly into said vat to one side of said mixing tool shaft, a dissolver disk affixed to said dissolver disk shaft for rotation therewith at a location in said vat to one side of said mixing tool shaft and above said mixing tool, a common drive motor for said mixing tool shaft and said dissolver disk shaft having a motor drive shaft, a clutch between only said motor drive shaft and said dissolver disk shaft for selectively connecting and disconnecting only said dissolver disk shaft, and transmission means between said dissolver disk shaft and said mixing tool shaft and said motor drive shaft for driving at least one of said dissolver disk and mixing tool shafts at variable speeds.

2. A vat mixer according to claim 1, wherein said transmission means comprises means connected only between said mixing tool shaft and said drive motor shaft for varying the speed of only said mixing tool shaft.

3. A vat mixer according to claim 2, wherein said means for varying the speed of said mixing tool shaft includes a variator including a drive pulley on said motor drive shaft and a driven pulley system located between said drive pulley and mixing tool shaft.

4. A vat mixer according to claim 1, wherein said transmission means includes means connected between said motor shaft and each of said dissolver disk shaft and said mixing tool shaft for varying the speed of both said dissolver disk and said mixing tool shaft.

* * * * *